US011185124B2

(12) United States Patent
Lemons

(10) Patent No.: US 11,185,124 B2
(45) Date of Patent: Nov. 30, 2021

(54) CHANNELED SHOE SOLE SYSTEM

(71) Applicant: Nicholas Lemons, Brooklyn, NY (US)

(72) Inventor: Nicholas Lemons, Brooklyn, NY (US)

( * ) Notice: Subject to any disclaimer, the term of this patent is extended or adjusted under 35 U.S.C. 154(b) by 0 days.

(21) Appl. No.: 17/067,665

(22) Filed: Oct. 10, 2020

(65) Prior Publication Data

US 2021/0059350 A1 Mar. 4, 2021

Related U.S. Application Data

(63) Continuation of application No. 16/926,081, filed on Jul. 10, 2020, which is a continuation of application No. PCT/US2020/039320, filed on Jun. 24, 2020.

(60) Provisional application No. 62/838,166, filed on Apr. 24, 2019.

(51) Int. Cl.

| | |
|---|---|
| ***A43B 13/14*** | (2006.01) |
| ***A43C 5/00*** | (2006.01) |
| ***A43C 1/00*** | (2006.01) |

(52) U.S. Cl.

CPC ..... *A43B 13/14* (2013.01); *A43C 1/006* (2013.01); *A43C 5/00* (2013.01)

(58) Field of Classification Search

CPC ..... A43C 1/00

See application file for complete search history.

(56) References Cited

U.S. PATENT DOCUMENTS

| | | | | |
|---|---|---|---|---|
| 2,495,984 | A * | 1/1950 | Roy | A43B 5/08 36/15 |
| 3,455,037 | A * | 7/1969 | Vlas | A43B 3/126 36/11.5 |
| 5,184,378 | A | 2/1993 | Batra | |
| 6,052,921 | A | 4/2000 | Oreck | |
| 6,128,834 | A * | 10/2000 | Vecchiola | A43B 3/101 36/11.5 |
| 6,286,233 | B1 * | 9/2001 | Gaither | A43C 1/00 36/50.1 |
| 6,499,234 | B2 * | 12/2002 | Manzi | A43B 3/122 36/100 |
| 7,287,342 | B2 * | 10/2007 | Keen | A43B 3/22 36/50.1 |
| 7,343,701 | B2 * | 3/2008 | Pare | A43C 1/06 36/50.1 |
| 7,703,220 | B2 * | 4/2010 | Aveni | A43B 1/04 36/45 |
| 8,844,167 | B2 * | 9/2014 | Greene | A43B 13/125 36/45 |
| 8,881,430 | B2 * | 11/2014 | Seamarks | D04B 1/22 36/45 |
| 9,049,902 | B2 * | 6/2015 | Baker | A43C 11/1493 |
| 9,220,318 | B2 * | 12/2015 | James | A43C 11/002 |
| 9,545,128 | B2 * | 1/2017 | Podhajny | A43B 1/04 |
| 2004/0181972 | A1 * | 9/2004 | Csorba | A43C 11/14 36/50.1 |

(Continued)

*Primary Examiner* — Jila M Mohandesi

(74) *Attorney, Agent, or Firm* — Charles Runyan; Runyan Law

(57) ABSTRACT

Shoe soles with channels for receiving shoelaces or other tightening devices. The channels penetrate through the sole crossing the lateral direction (long length of the foot). Variation of the lacing pattern provides for many different aesthetic or functional arrangements. Some versions have tubes in or on the walls of the upper of the shoe. These can shield the laces from view, abrasion, etc.

16 Claims, 8 Drawing Sheets

(56) References Cited

U.S. PATENT DOCUMENTS

| | | | |
|---|---|---|---|
| 2004/0226190 | A1 | 11/2004 | Elkington et al. |
| 2005/0055844 | A1 | 3/2005 | Yu |

* cited by examiner

CHANNELED SHOE SOLE SYSTEM

CROSS-REFERENCE TO RELATED APPLICATIONS

This application is a Continuation of U.S. patent application Ser. No. 16/926,081, filed on Jul. 10, 2020, pending, which is a Continuation of PCT/US20/39320, filed on Jun. 24, 2020, pending, which is related to and claims priority to U.S. Provisional Patent Application No. 62/838,166 filed 24 Apr. 2019 (priority restored), which is incorporated by reference.

BACKGROUND

The following includes information that may be useful in understanding the present disclosure. It is not an admission that any of the information provided herein is prior art nor material to the presently described or claimed inventions, nor that any publication or document that is specifically or implicitly referenced is prior art.

A shoe is an item of footwear intended to protect and comfort a user while the wearer is doing various activities. Shoes, such as boots and sneakers, have shoelaces that are commonly used to secure the shoes on the foot of the wearer. They typically have a pair of strings or cords, one for each shoe, finished off at both ends with stiff sections, known as aglets. Each shoelace typically passes through a series of holes, eyelets, loops, or hooks on either side of the shoe. Loosening the lacing allows the shoe to open wide enough for the foot to be inserted or removed. Tightening the lacing and tying off the ends secures the foot within the shoe.

Typically, shoelaces only pass over each side of the shoe around the tongue portion on the front side of the shoe. Typical lacing can cause discomfort to the wearer, especially when the shoes are worn for extended periods. Additionally, traditional shoe lacing methods can be uninteresting in appearance and style. A suitable solution is desired.

Various attempts have been made to solve problems found in shoe lacing art. Among these are found in U.S. Pat. Nos. 6,052,921; 6,286,233; 5,184,378; and Publication Nos. 2005/0055844; and 2004/0226190. This art is representative of shoe lacing systems.

U.S. Pat. No. 6,052,921 relates to a shoe having an ergometric shoe lace design. The laces pass through tubes on the tongue portion of the shoe and extend down to the sole of the shoe on either side of the shoe where they pass through tubes on or near the perimeter of the sole. The laces crisscross the foot in this manner to secure the foot from up and down motion in the shoe. Optionally the lace may continue to be wrapped around the heel of the foot through ankle tubes and heel tubes to secure the foot from toe to heel movement in the shoe. This is particularly of advantage for shoes used in sporting activities. In this manner the upper of the shoe is not pulled together on either side of the tongue as in conventional shoes, thus avoiding stresses in the upper that tend to put pressure on and rub against the user's foot. Thus, the shoe is comfortably and securely held to the user's foot.

U.S. Pat. No. 6,286,233 has an internal lacing system for footwear wherein a plurality of lace guides having rotatable rollers are secured and strategically positioned throughout a shoe to facilitate securing the foot within the shoe. More specifically, an elongated lace having a first end and a second end is internally channeled through each of the lace guides and over the respective rollers, wherein the second end of the elongated lace exits the internal of the shoe at the upper portion of the shoe proximal to the shoe opening. The first end of the elongated lace is secured within the shoe proximal to the toe area of the shoe. To tighten the shoe, a user simply pulls on the exposed second end of the lace thereby allowing the lace to roll along each respective roller positioned within each lace guide. Additionally, because the first end of the lace is fixed, the pulling on the second end of the lace will result in a reciprocating force about each lace guide thus securely tightening the shoe around the user's foot.

U.S. Pat. No. 5,184,378 relates to a lacing system for shoes employing a plurality of strips, wherein the lower ends of the strips are rigidly attached to the lower portion of the shoe and the upper portion of the strips have a lacing ring fixed thereto. The upper ends of the strips are slideably retained by loops on the upper of the shoe, and the middle portion of the strips are unattached to the quarter of the shoe. The strips transfer the lacing force evenly along the quarter to mold the quarter of shoe evenly to the wearer's feet.

None of the above inventions and patents, taken either singly or in combination, describes the devices disclosed below. Thus, a need exists for a reliable, ergonomic shoe lacing system, and to avoid the problems mentioned above.

TECHNICAL FIELD

The present invention generally relates to the field of shoes and athletic shoes and, more specifically, relates to structures and methods to better secure shoes to a user's foot. It also relates to ergonomic shoe lacing.

SUMMARY

Given these disadvantages inherent in the known shoe art, the present disclosure provides a novel shoe having channels through the soles for receiving laces or shoestrings. One general aspect includes a shoe with a sole having a channel extending through the sole and shoestrings extending through the sole channel. Other embodiments of this aspect include corresponding various other shoes.

Implementations may include one or more of the following features. The shoe may include two or three or more channels extending through the sole. One or more channels pass from the medial side to the lateral side, or one or more channels pass from the lateral side to the medial side. The shoestrings extend over the shoe, which in some embodiments, may include a shoestring catch. In some embodiments, a plurality of channels receives the shoestrings. Sometimes the shoestrings extend around a user's ankle. An upper cover can cover the upper and serve as a place to attach shoestrings. In some embodiments, the place to attach shoestrings includes shoestring mounts or eyelets. The laces or shoestring may be covered by a shoestring strip extending over the laces or shoestrings. The upper cover may include shoestring mounts or eyelets and may include a shoestring strip extending over the laces. The shoe is an athletic shoe. A method may include providing the shoe and tightening the shoe to a user's foot. The tightening step may further include extending the laces through the channels and securing the laces with a shoestring catch.

A channeled shoe sole system includes a sole, at least one shoestring, and one or more channels for receiving the shoestring. The system may be configured for shoes having an upper-body portion. The channel runs through the sole of the shoe from one side to the other. The channel does not run through the upper-body portion. The channel may run through the sole directly across from one side to the other side, or it may run at an angle through the sole to provide a different angle for the shoestring to thread through it. In one embodiment, the channels may cross one another as a crisscross angle. There can be numerous channels on the sole of the shoe. The channels enable the shoestring to thread through them and cross over the upper-body portion in many ways, styles, and functional methods.

For purposes of summarizing the invention, certain aspects, advantages, and novel features of the invention have been described. Not necessarily all such advantages may be achieved by any one particular embodiment of the invention. Thus, the invention may be embodied or carried out in a manner that achieves or optimizes one advantage or group of advantages without necessarily achieving other advantages. The features of the invention that are believed to be novel are particularly pointed out and distinctly claimed in this specification. These and other features, aspects, and advantages of the present devices are disclosed along with the following drawings and detailed description.

BRIEF DESCRIPTION OF THE DRAWINGS

The figures that accompany the written portion of this specification illustrate variations and methods of use for the present devices.

Figure 1:
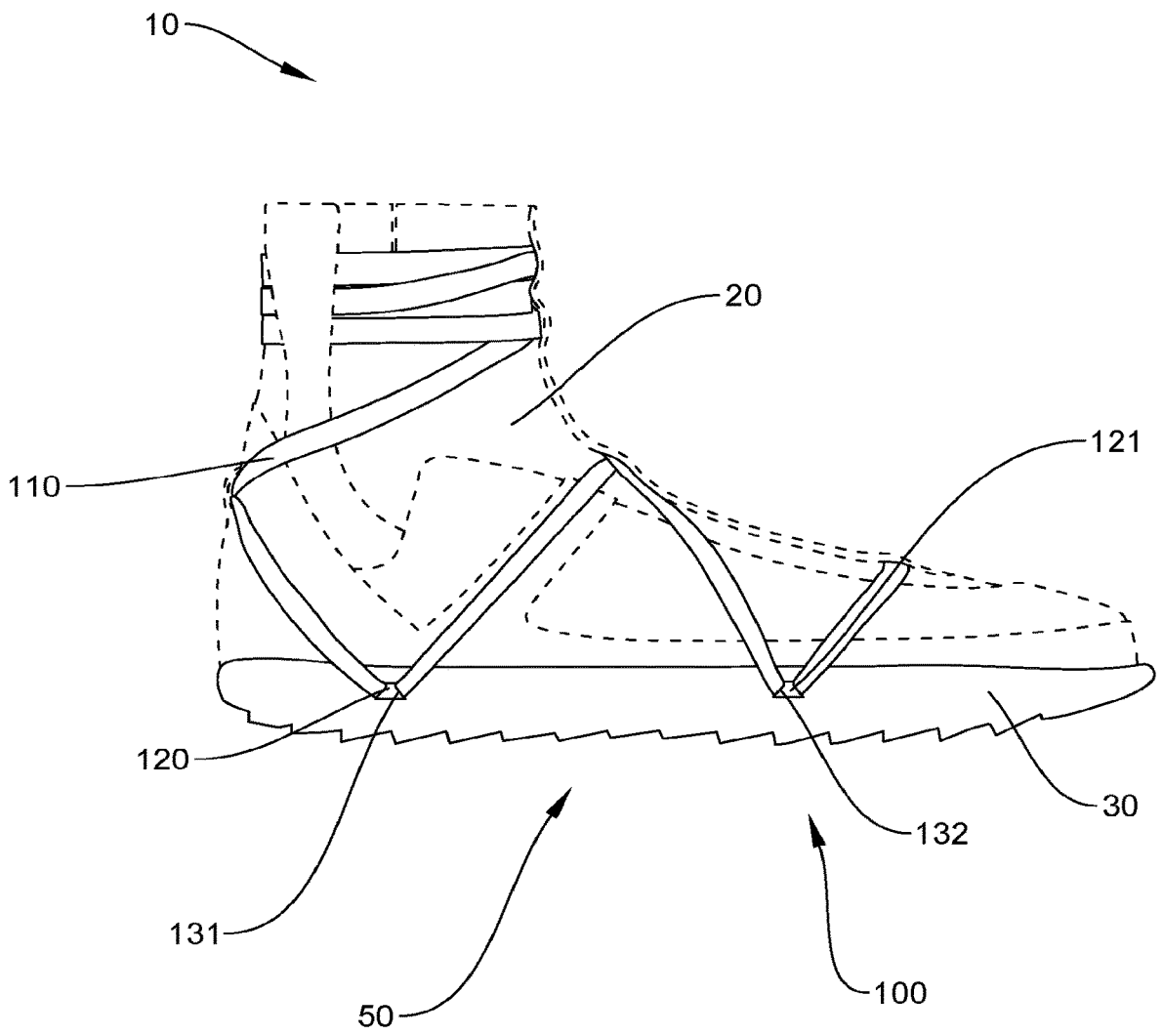
FIG. 1 is a lateral side view of a shoe according to the current disclosure.

The various embodiments of the present invention are described with the appended drawings.

DETAILED DESCRIPTION

The terminology is used for describing particular example embodiments only and is not intended to be limiting. As used, the singular forms "a", "an", and "the" may be intended to include the plural forms as well, unless the context indicates otherwise. The terms "comprises", "comprising", "including", and "having", are inclusive and therefore specify the presence of stated features, integers, steps, operations, elements, or components, but do not preclude the presence or addition of one or more other features, integers, steps, operations, elements, components, or groups of these. The order of method steps, processes, and operations do not necessarily require performance in the disclosed or illustrated order unless specifically identified as an order of performance. It is also to be understood that additional or alternative steps may be employed, When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on", "directly engaged to", "directly connected to" or "directly coupled to" another element or layer, there may be no intervening elements or layers present. Other words used to describe the relationship between elements should be interpreted in a like fashion (e.g., "between" versus "directly between", "adjacent" versus "directly adjacent", etc.).

Although the terms first, second, third, etc. may be used to describe various elements, components, regions, layers, or sections, these elements, components, regions, layers, or sections should not be limited by these terms. These terms may be only used to distinguish one element, component, region, layer, or section from another region, layer, or section. Terms such as "first", "second", and other numerical terms do not imply a sequence or order unless indicated by the context. Thus, a first element, component, region, layer, or section discussed below could be termed a second element, component, region, layer, or section without departing from this disclosure.

Spatially relative terms, such as "inner", "outer", "beneath", "below", "lower", "above", "upper" and the like, may be used for ease of description to describe one element or feature's relationship to another element or feature as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors interpreted accordingly.

The description of the embodiments has been provided for purposes of illustration and description. It is not intended to be exhaustive or to limit the invention. Individual elements or features of a particular embodiment are generally not limited to that particular embodiment but, where applicable, are interchangeable and can be used in a selected embodiment, even if not explicitly shown or described. The same may also be varied in many ways. Such variations are not a departure from the invention, and all such modifications are included within the invention's scope.

Channel. The channel runs through the sole 100 of the shoe from one side to the other. In some embodiments, it does not run through the upper-body of the shoe. The channel can be a round channel or a square channel or a triangle channel or any other shape channel. It can have a metal shroud running inside of the channel or a wood channel or any other material making up the channel. The channel can be as wide as the channel needs to be for allowing wider or numerous shoestrings running through the channel. The channel may run through the sole 100 directly across from one side to the other, or it may run at an angle through the sole 100 to provide a different angle for the shoestring 110. The channel may cross one another as a criss-cross angle. There can be numerous channels 120, 121, 421, and 423 in the sole 100. They can be from one channel to as many channels as the maker wishes. The shoestrings to run through the channels 120, 121, 421, and 423 and run across the top of the shoe in various ways, styles, and functional methods. In some versions, the channel is surrounded or entirely surrounded by sole 100 material except at openings into the channel on the sides of the sole Sole. The sole 100 can be any kind of material from rubber to leather to plastic to foam to cork and to any other kind of material that would be appropriate to the sole 100 of a shoe as the maker wishes. The sole 100 may be made stronger at any size to allow the shoestrings 110 to run through the channel without harming durability. The sole 100 can run up higher on the back or front or side of the shoe to allow more channels 120, 121, 421, and 423.

Shoestrings. Shoestrings 110 or laces are as typical for laced shoes. The shoestrings 110 run through the channel in the sole. They can run through the channel as many times as necessary to achieve a particular style, look, or functionality. Depending on the desired locale or functionality, the shoestrings 110 can wrap around the top through, under, or over any straps, channels, eyelets, or other shoe components.

The channeled shoe sole 100 is a unique concept in the shoe industry. It allows for a unique style and functionality with sports shoes, dress shoes, walking shoes, men's shoes, and women's shoes and any other kind of shoe style that the maker wishes.

The present invention is directed to a channeled shoe sole system. In one embodiment of the present invention, the channeled shoe sole system may include a sole, at least one shoestring, and one or more channels 120, 121, 421, and 423 for receiving the shoestring. The system may be configured for shoes having an upper-body portion (e.g., tongue, vamp, heel, etc.). The channel may have an inlet opening and an outlet opening such that the shoestring can be threaded therethrough from one side of the channel to the other. There can be numerous channels 120, 121, 421, and 423 on the sole 100. The channel may enable the shoestrings 110 to thread through them and run across the upper-body portion in many ways, styles, and functional methods.

FIG. 1 shows a channeled shoe sole system that includes the sole, the shoestrings 110, and the channels 120, 121, 421, and 423. As illustrated, the channels 120, 121, 421, and 423 may pass through the sole 100 from one side to the other. The channels 120, 121, 421, and 423 do not run through the upper-body portion (as indicated by the broken lines) like traditional lacing methods. The channel may run through the sole 100 directly across from one side to the other side, or it may run at an angle through the sole 100 to provide a different shoestring direction. In some embodiment, the channels 120, 121, 421, and 423 may cross one another at a criss-cross angle.

The channel may be round, square, triangle, or any other shape. It can have a metal shroud lining inside of the channel. However, wood or any other suitable (preferably rigid) material may be considered. The channel may be wide enough to allow wider or multiple shoestrings 110 to thread through one or more of the channels 120, 121, 421, and 423. Depending upon the embodiment, shoe 10 comprises one, two, three, four, or five, or more channels 120, 121, 421, and 423 in sole 100.

FIG. 1 depicts a lateral side view of shoe 10, as disclosed in this document. Shoe 10 has upper 20 and lateral side 50 shown in FIG. 1. Sole 100 is shown with back channel 120 and front channel 121. Each of these channels has openings on both sides of shoe 10. FIG. 1 shows lateral opening 131 to back channel 120 and lateral opening 132 two front channels 121.

In some embodiments, shoe 10 can be any type of footwear or shoe that is typically secured to the user's foot with shoestrings 110 or shoestrings 110 or that could be secured to the user's foot with laces or ribbon- or rope-like materials. Throughout this disclosure, laces and shoestring may be used interchangeably. FIG. 1 shows an athletic style of shoe 10.

Shoelaces, shoestrings, or laces 110 are shown in FIG. 1, in some instances passing over the shoe, and in some instances passing through back channel 120 or front channel 121, and in some cases passing around ankle portion 21 of shoe 10.

Figure 2:
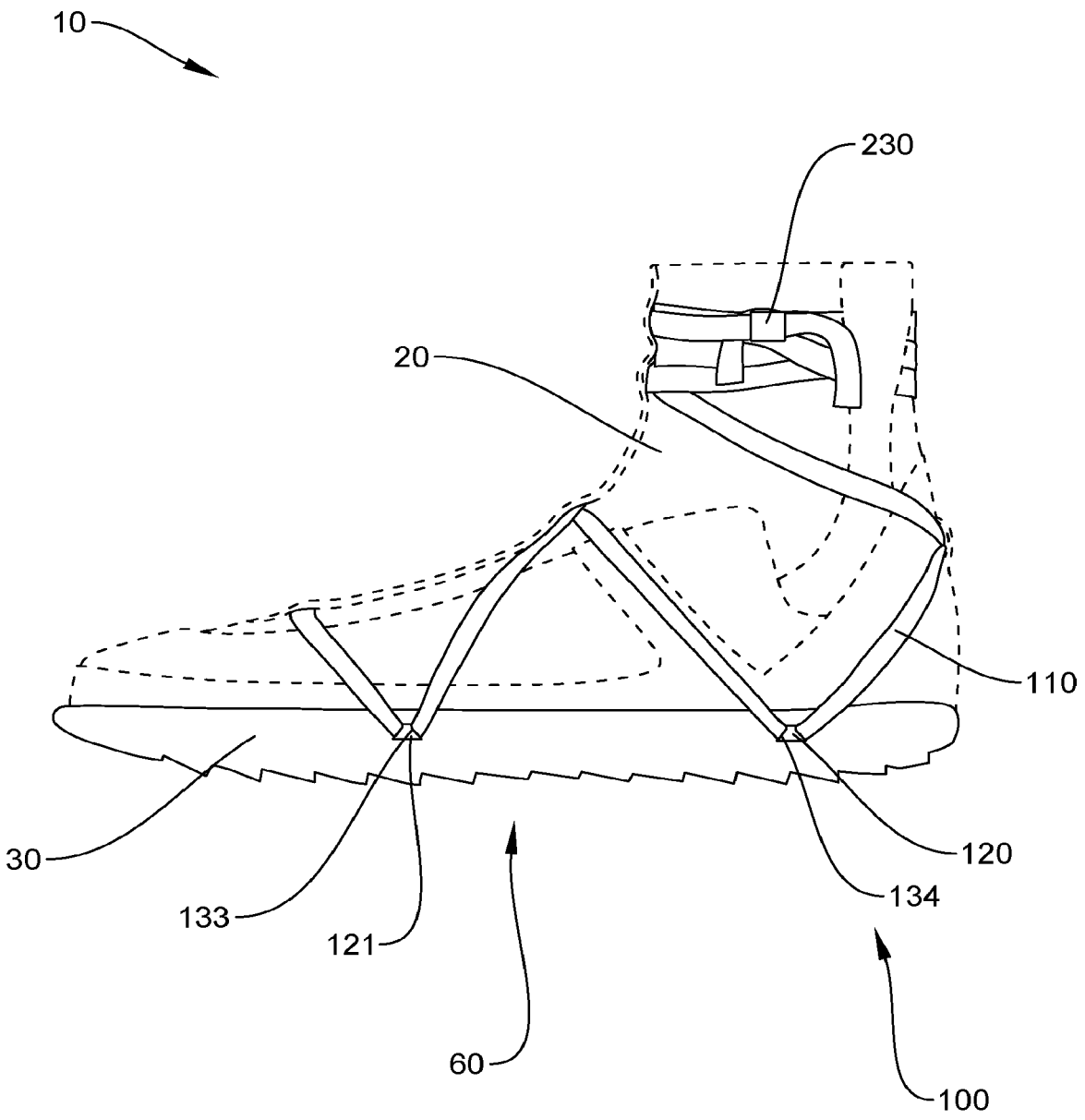
FIG. 2 is a medial side view of the shoe of FIG. 1.

FIG. 2 shows a left side view of the channeled shoe sole system. The sole 100 may be any kind of material, including rubber, leather, plastic, foam, cork, and other suitable material. The sole 100 may be strengthened to offset the weakening possibly caused by the channels 120, 121, 421, and 423. The sole 100 can extend up higher on the back, front, or side of the shoe 10 to allow placement of more channels 120, 121, 421, and 423.

FIG. 2 shows medial side 60 of shoe 10. Again, shoe 10 has sole 100 and upper 20. The figures show medial opening 134 of back channel 120 and medial opening 133 of front channel 121. The figures further disclose an example of the lacing of shoestrings 110. Additionally, FIG. 2 depicts shoestring catch 230, which can be any component that allows shoestrings 110 to be tied or secured or otherwise held together as is typical for laced shoes. In some embodiments, the laces are held together by merely tying a bow.

Figure 3:
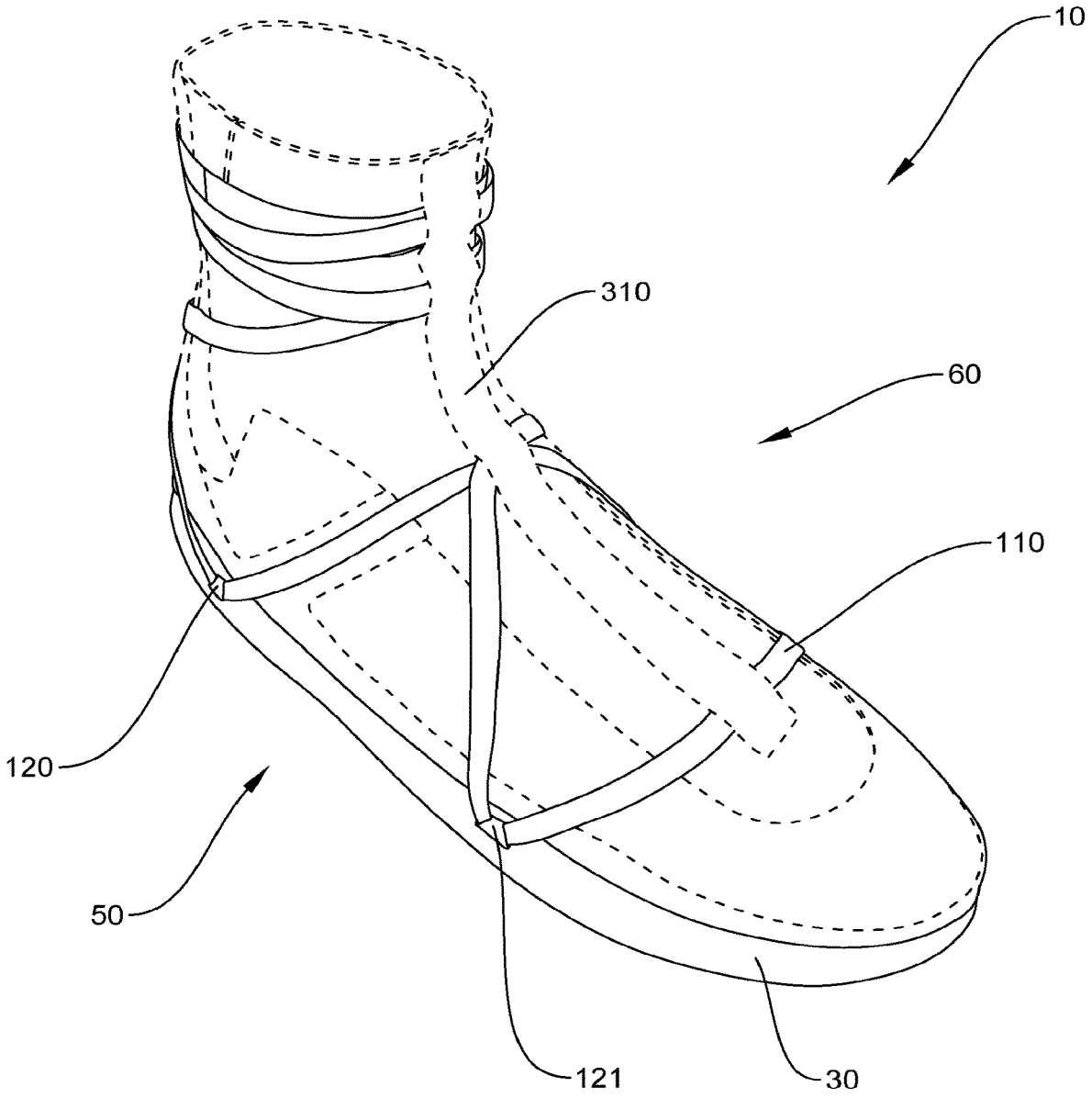
FIG. 3 is a perspective view of a version of the shoe of FIG. 1.

FIG. 3 shows a perspective view of the channeled shoe sole system. The shoestring passes through the channel and may thread through it as many times as the wearer desires to lend a particular style, look, or functionality. Further, the shoestrings 110 can run through the channel allowing the shoestrings 110 to be wrapped around the upper-body portion through, under, and over any straps, loops, eyelets, or anything else constructed into the upper-body portion so that the shoestrings 110 have a particular look or functionality. As illustrated, the shoestrings 110 thread through sections like the heel, the ankle, and the tongue of the shoe, creating a novel appearance. Additionally, such a shoe lacing method may increase comfort for the wearer by providing a more secure fastening means around the upper-body portion.

FIG. 3 is an upper perspective view of shoe 10, indicating medial side 60 and lateral side 50. FIG. 3 additionally depicts laces strip 310, which can be situated as desired on upper 20 to cover shoestrings 110 or to otherwise secure shoestrings 110.

Figure 4:
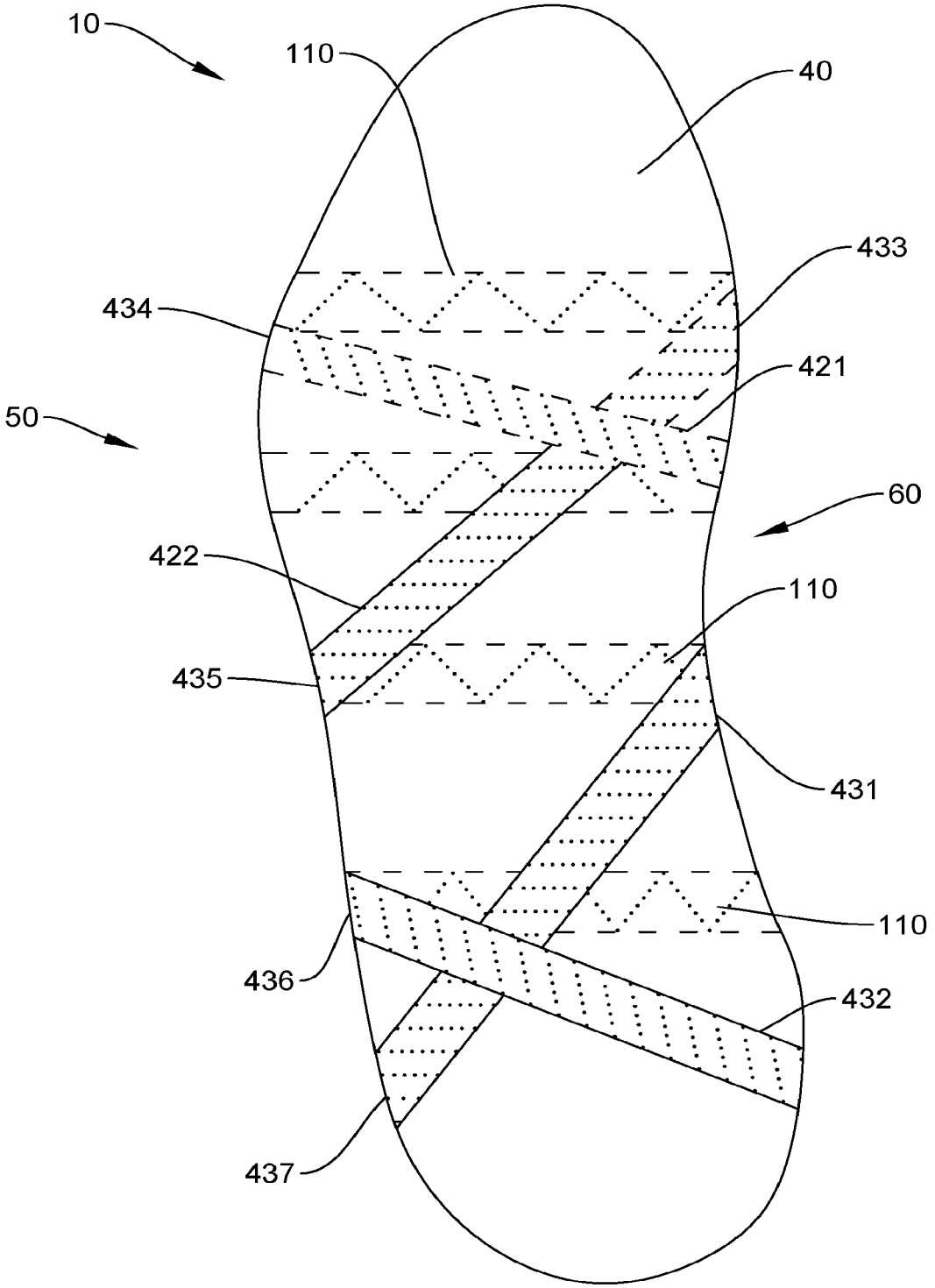
FIG. 4 is a bottom plan view of a shoe sole according to this disclosure.

FIG. 4 depicts a bottom plan view of sole 100 of shoe 10. Surface 101 of sole 100 points upward, in this view. In addition to back channel 120 and front channel 121, this FIG. depicts third channel 421 and fourth channel 423. As shown, channels 120, 121, 421, and 423 do not extend perpendicular to the long axis of the shoe in all embodiments. Some embodiments exist where channels 120, 121, 421, and 423 are skew to a longitudinal axis of shoe 10, and in other embodiments, channels 120, 121, 421, and 423 are substantially perpendicular to the longitudinal axis of the shoe. Comparing FIG. 3 to FIG. 4 shows that channels 120, 121, 421, and 423 are situated above surface 101 of sole 100. In FIG. 4, channels 120, 121, 421, and 423 are represented with dotted lines arranged across the object in a striped fashion. Shoestrings 110 are not shown passing through channels 120, 121, 421, and 423. But they are depicted with a dotted zigzag line in FIG. 4. Shoestrings 110 in FIG. 4 pass over the top of shoe 10 in some embodiments. FIG. 4 illustrates just one variation of channel and shoestring directions for shoes of this disclosure.

Figure 5:
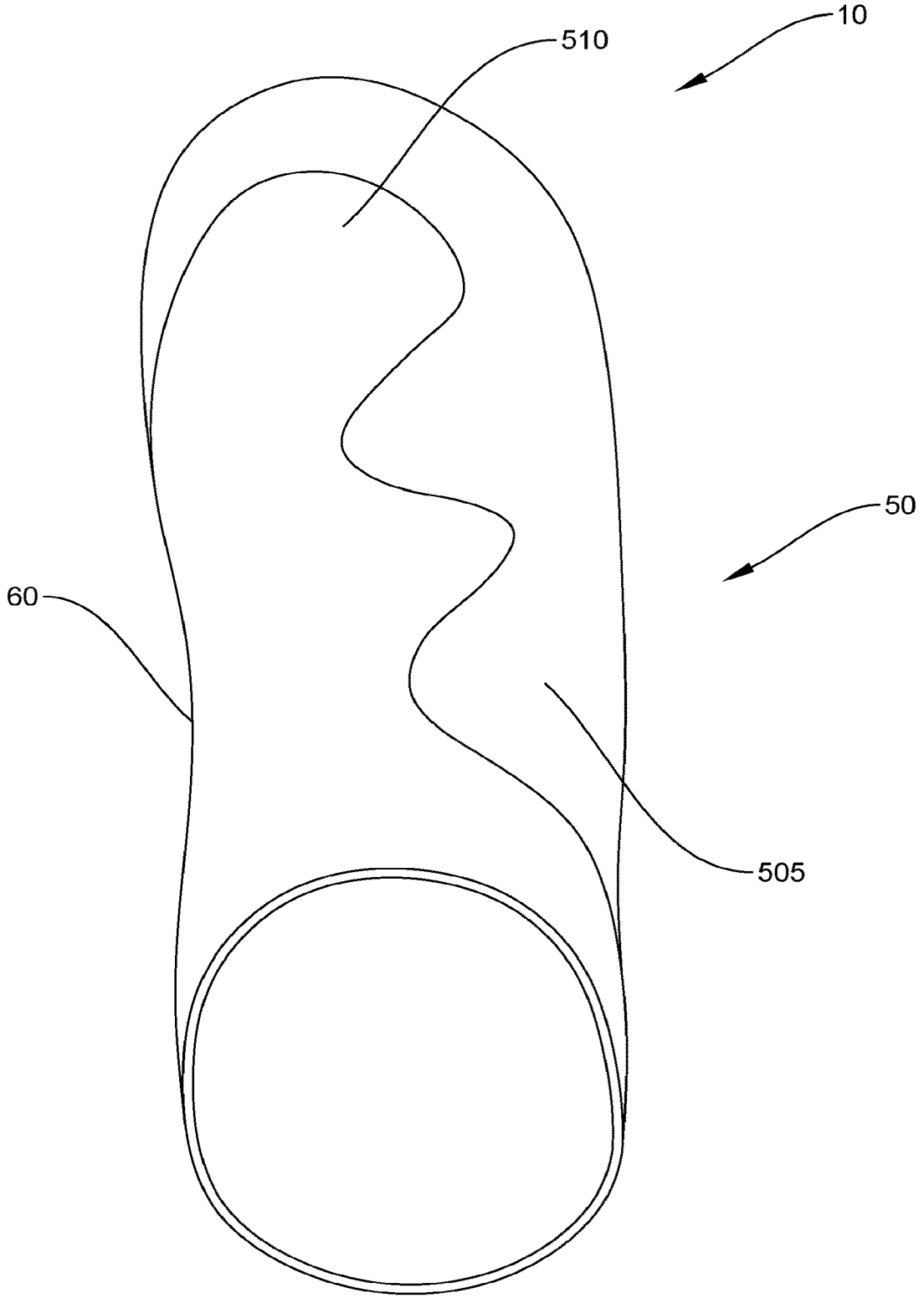
FIG. 5 is an upper plan view of another shoe according to this disclosure.

FIG. 5 depicts a top view of shoe 10, indicating lateral side 50 and medial side 60. This figure also illustrates upper cover 510. Upper cover 510 extends partially or entirely over upper 20. Its use is better seen in FIG. 6, where shoe 10 has upper cover 510. Upper cover 510 has front shoestring attachment 610 and rear shoestring attachment 620. This version of shoe 10 has two attachments on upper cover 510, but other embodiments exist having different numbers of shoestring attachment 610.

Figure 6:
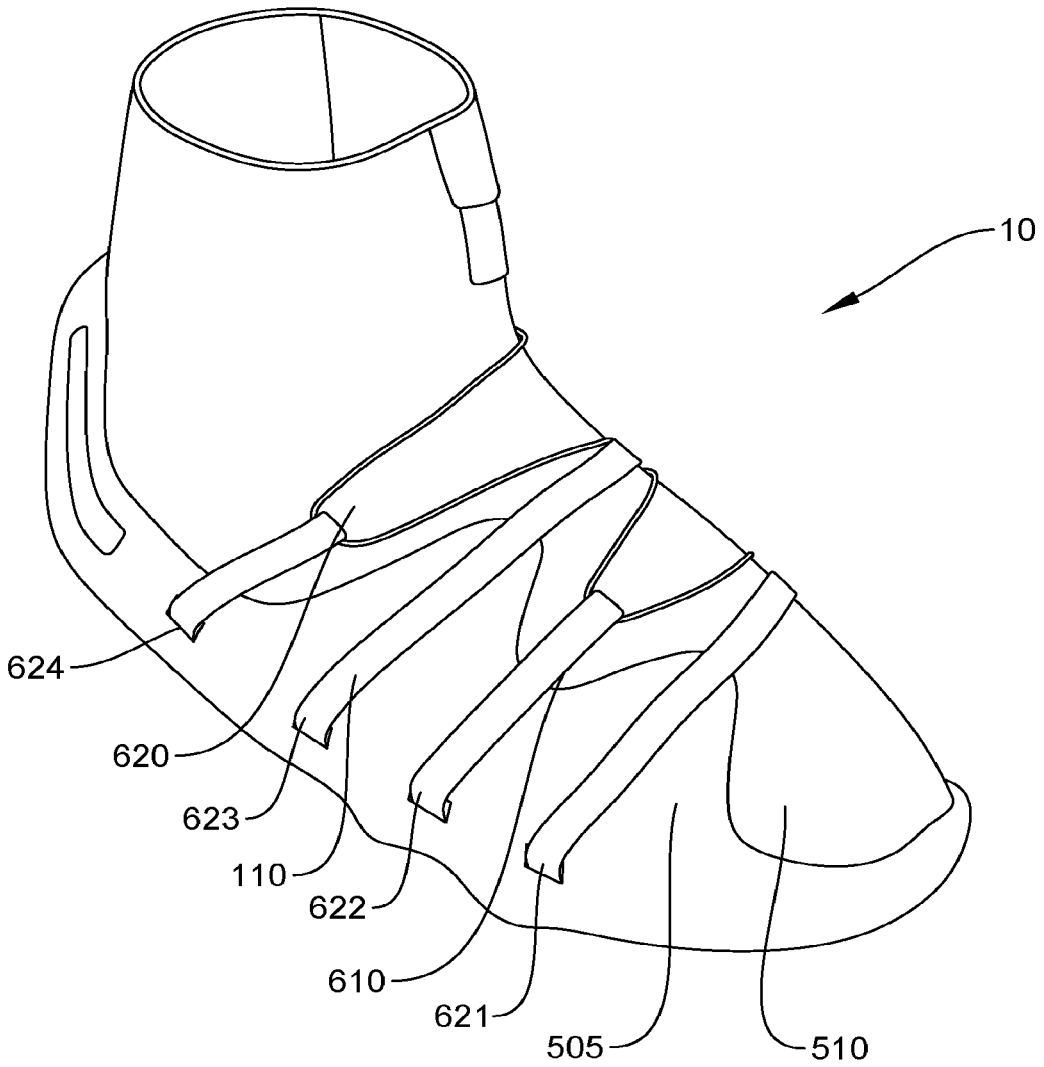
FIG. 6 is a perspective view of an alternative version of the shoe according to this disclosure.

Shoe 10 in FIG. 6 has four channels indicated by lateral opening to channel A, 621, lateral opening to channel B, 622, lateral opening to channel C, 623, and lateral opening to channel D, 624. In this figure, laces 110 are shown passing from shoestring attachment 610 on upper cover 510 through the openings to the channels. For instance, front shoestring attachment 610 secures shoestring 110 to upper cover 510, and shoestring 110 extends from front shoestring attachment 610 into lateral channel opening 622. Likewise, rear shoestring attachment 620 attaches shoestring 110 to upper cover 510 and extends from upper cover 510 into lateral opening 624.

Figure 7:
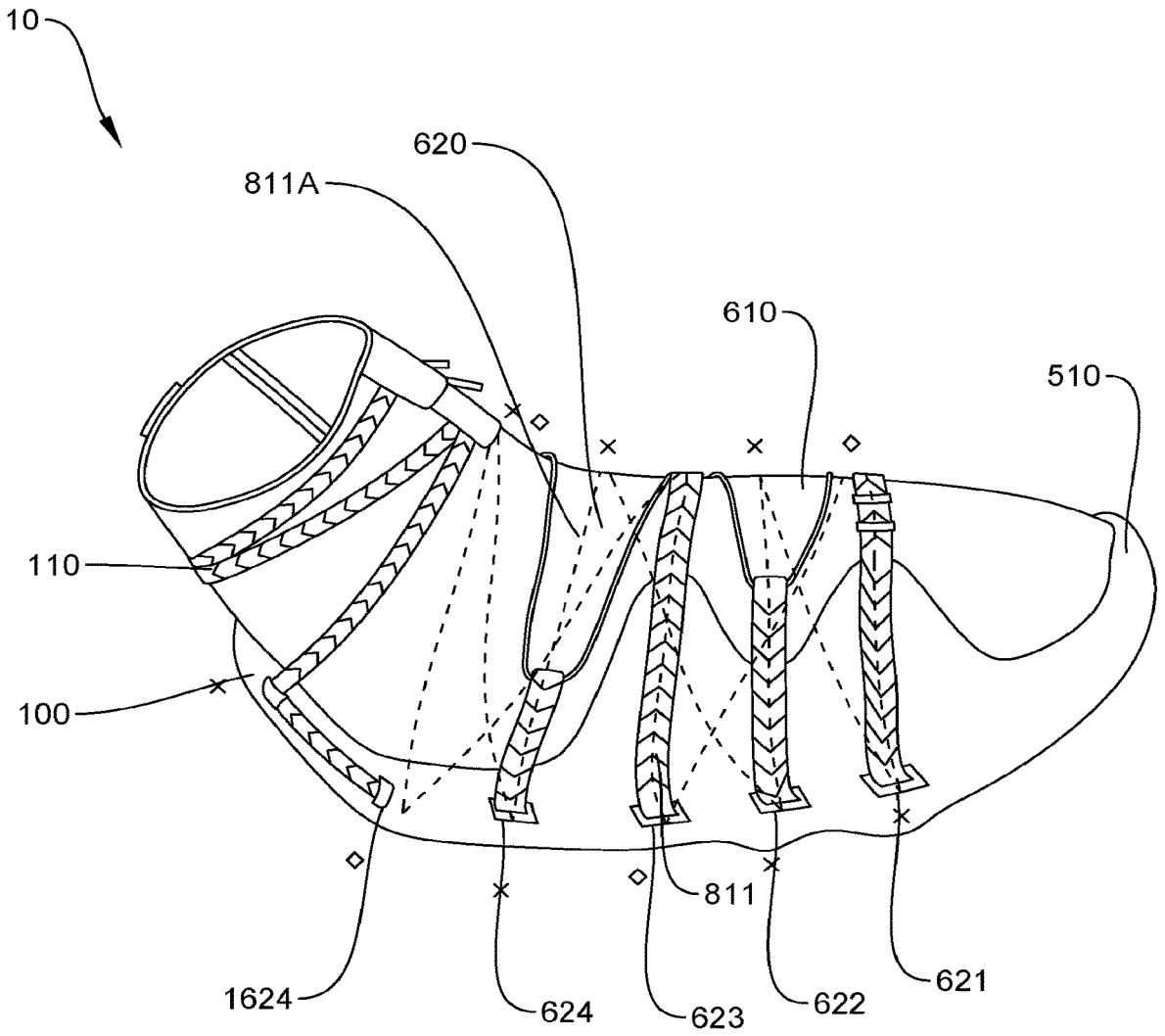
FIG. 7 is a front right-side view of an alternative version of the shoe according to this disclosure.
Figure 8:
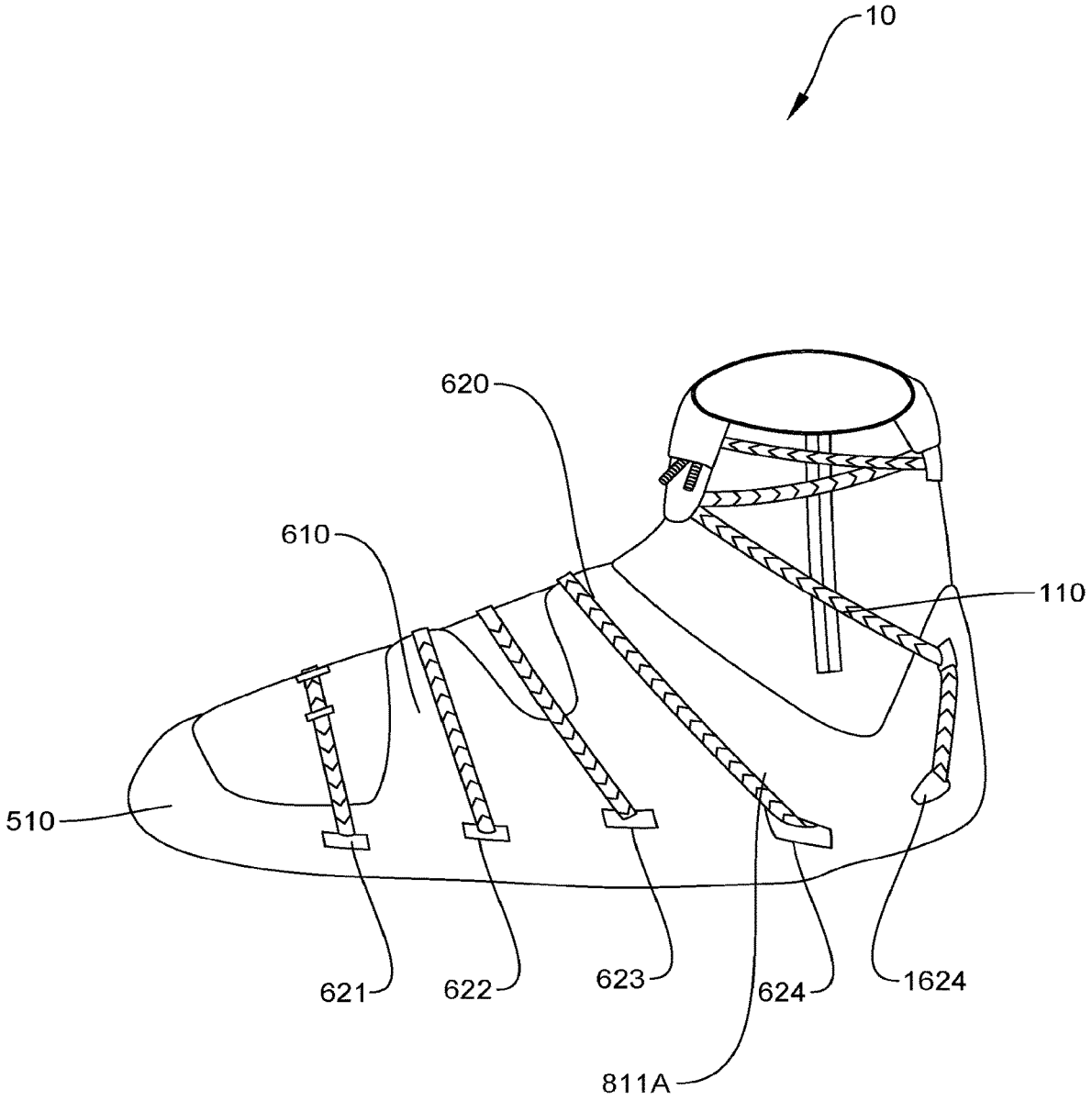
FIG. 8 is a left-side view of an alternative version of the shoe according to this disclosure.

FIG. 7 shows medial side 60 of shoe 10. Again, shoe 10 has sole 100 and upper 20. The figures show medial opening 134 of back channel 120 and medial opening 133 of front channel 121. The figure further discloses an example of the lacing of shoestrings 110. Additionally, FIG. 8 depicts shoestring catch 230, which can be any component that allows shoestrings 110 to be tied or secured or otherwise held together as is typical for laced shoes. In some embodiments, the laces are held together by merely tying a bow.

In this depiction, the shoestring passes through the channel and may thread through it as many times as the wearer desires to lend a particular style, look, or functionality. Further, the shoestrings can run through the channel allowing the shoestrings to be wrapped around the upper-body portion through, under, and over any straps, loops, eyelets, or anything else constructed into the upper-body portion so that the shoestrings have a particular look or functionality. As illustrated, the shoestrings thread through sections like the heel, the ankle, and the tongue of the shoe, creating a novel appearance. Additionally, such a shoe lacing method may increase comfort for the wearer by providing a more secure fastening means around the upper-body portion.

Shoe 10, in FIG. 7, has five channels through the sole 10 indicated by lateral opening to channel A, 621, lateral opening to channel B, 622, lateral opening to channel C, 623, and lateral opening to channel D, 624, and channel E, 1624. In this figure, laces 110 are shown passing from shoestring attachment 610 on upper cover 510 through the openings to the channels. For instance, front shoestring attachment 610 secures shoestring 110 to upper cover 510, and shoestring 110 extends from front shoestring attachment 610 into lateral channel opening 622. Likewise, rear shoestring attachment 620 attaches shoestring 110 to upper cover 510 and extends from upper cover 510 into lateral opening 624.

Shoestring tube 811 serves as a passage for shoestring 110 as it extends over shoe upper 20. Thus shoestring 110 passes through sole 100 and over upper 20, but in some versions, those having shoestring tube 811, shoestring 110 is not exposed along its entire length. Shoestring tube 811 can stretch from a channel on one side of the upper, over upper 20, to a channel on the other side of upper 20. In some versions, tube 811 contains shoestring 110 the entire distance across upper 20. In other versions, tube 811 starts and stops along the path as desired for functional or aesthetic reason.

In use, a user takes shoe 10 and wears it as is typical with shoes. The user then laces the shoes or tightens the already laced shoes in any of a large number of different configurations enabled by having channels 120, 121, 421, and 423 through sole 100. Some of these arrangements have purely aesthetic value, some have purely functional value in that they allow the shoes to be secured in a different way than is sometimes typical in shoes, and some have both functionally and ecstatic value. For instance, in some sports, participants may prefer their shoes tightly secured to their foot but maintain a very loose ankle portion 21 of shoe 10. Having a variety of channels 120, 121, 421, and 423 allows the user to place shoestrings 110 through the channel and increase the tightness of the shoe at that specific point rather than being forced to use regular eyelets.

The exact specifications, materials used, and method of use of the channeled shoe sole system may vary upon manufacturing.

The embodiments of the invention described herein are exemplary, and numerous modifications, variations, and rearrangements can be readily envisioned to achieve substantially equivalent results, all of which are intended to be embraced within the spirit and scope of the invention.

The steps described in the method can be carried out in many different orders according to user preference.

What is claimed is:

1. A shoe comprising
a sole with a channel extending through the sole
a first shoestring extending through the sole channel,
a second shoestring,
a cover for a shoe upper comprising shoestring mounts or eyelets,
and
a lengthwise shoestring strip extending over the shoestrings,
wherein
the shoestring
extends over the shoe;
extends through a plurality of the channels;
and
sits in a tube under the surface of the upper, over the surface, or in a wall of the upper.

2. The shoe of claim 1 comprising two or more channels extending through the sole.

3. The shoe of claim 2 comprising three or more channels extending through the sole.

4. The shoe of claim 3, wherein the sole has a lateral side and a medial side, and the channel passes from the medial side to the lateral side, or the channel passes from the lateral side to the medial side.

5. The shoe of claim 1, wherein the shoestring extends through a plurality of the channels.

6. The shoe of claim 5, wherein a first portion of the upper extends around an ankle of a user.

7. The shoe of claim 6 wherein the shoestring sits in a tube under the surface of the first portion, over the surface of the first portion, or in the wall of the first portion.

8. The shoe of claim 7 further comprising an upper cover.

9. The shoe of claim 8 wherein the shoestring sits in a tube under a surface of the upper cover, over the surface, or in a wall of the upper cover.

10. The shoe of claim 9, wherein the shoe is an athletic shoe.

11. The shoe of claim 2, wherein the shoe is an athletic shoe.

12. The shoe of claim 2, wherein the shoestring extends through a plurality of the channels.

13. The shoe of claim 1, wherein the shoe is an athletic shoe.

14. A method comprising
providing
a shoe comprising
a sole with a channel extending through the sole,
a first shoestring extending through the sole channel, a second shoestring, a cover for a shoe upper comprising shoestring mounts or eyelets, and a lengthwise shoestring strip extending over the shoestrings, wherein the shoestring extends over the shoe; extends through a plurality of the channels; and sits in a tube under the surface of the upper, over the surface, or in a wall of the upper and tightening the shoe to a user's foot.

15. The method of claim 14, wherein the tightening step comprises moving the shoestring through the channels, and securing the shoestring by tying the shoestring or securing the shoestring with a shoestring catch.

16. The shoe of claim 4, wherein over the shoe means from the medial to the lateral side or from the lateral to the medial side.

* * * * *